US006343535B1

(12) United States Patent
Gaudron

(10) Patent No.: US 6,343,535 B1
(45) Date of Patent: Feb. 5, 2002

(54) DEVICE FOR ADVANCING CHARGES IN A POWDER-ACTUATED TOOL, AND IMPROVED TOOL INCLUDING THE SAME

(75) Inventor: Paul Gaudron, Stamford, CT (US)

(73) Assignee: Powers Fastening, Inc., New Rochelle, NY (US)

( * ) Notice: Subject to any disclaimer, the term of this patent is extended or adjusted under 35 U.S.C. 154(b) by 0 days.

(21) Appl. No.: 09/351,899

(22) Filed: Jul. 13, 1999

(51) Int. Cl.[7] ..... F41A 9/00

(52) U.S. Cl. ..... 89/33.01; 89/1.14; 89/33.1; 89/33.14; 89/33.2; 227/9; 227/10; 227/11; 42/1.12

(58) Field of Search ..... 227/9, 10, 11; 42/1.12; 89/33.01, 33.1, 33.14, 33.2, 1.14

(56) References Cited

U.S. PATENT DOCUMENTS

| | | | | |
|---|---|---|---|---|
| 1,040,692 A | * | 10/1912 | Kjellman | 89/33.2 |
| 2,027,893 A | * | 1/1936 | Williams | 89/33.2 |
| 3,067,454 A | * | 12/1962 | Catlin et al. | 42/1.12 |
| 3,554,425 A | * | 1/1971 | Oesterle | 227/10 |
| 3,565,313 A | * | 2/1971 | Seghezzi et al. | 227/10 |
| 3,609,901 A | * | 10/1971 | Necas | 42/69 R |
| 5,220,123 A | * | 6/1993 | Oehry | 89/1.14 |

FOREIGN PATENT DOCUMENTS

| | | | | |
|---|---|---|---|---|
| DE | 1808703 | * | 10/1970 | |
| GB | 1239267 | * | 7/1971 | B25C/1/10 |
| GB | 2189012 A | * | 10/1987 | F41D/10/20 |

* cited by examiner

*Primary Examiner*—Charles T. Jordan
*Assistant Examiner*—John Richardson
(74) *Attorney, Agent, or Firm*—Hopgood, Calimafde, Judlowe & Mondolino LLP

(57) ABSTRACT

A combustion activated tool includes a housing having a longitudinal bore that extends and connects with a vertical bore, a piston and piston guide disposed within the longitudinal bore and moveable axially therein, and an advance lever having a reset end and an advancing end, the lever disposed on a pivot skew to the axis of the longitudinal bore, the lever having an axis essentially parallel with the longitudinal bore, the advancing end of the lever attached on an arm of the lever angled to one side of the axis of the longitudinal bore and effective to engage teeth on the side of a strip of charges disposed in the vertical bore, the reset end of the lever being disposed on the same side of the axis of the longitudinal bore engaging the piston guide along an edge of the lever.

3 Claims, 4 Drawing Sheets

DEVICE FOR ADVANCING CHARGES IN A POWDER-ACTUATED TOOL, AND IMPROVED TOOL INCLUDING THE SAME

BACKGROUND OF THE INVENTION

1. Field of the Invention

This invention relates to improvements in the automatic advancing of a strip of charges used in a powder-actuated tool for driving a fastener into a substrate, especially a device for advancing the charges and an improved combustion-activated tool that uses the device and method.

2. State of the Art

Portable combustion-powered tools for use in driving fasteners into workpieces are known and described in the literature. Generally, such devices have the outward geometry of a pistol or gun with a combustion chamber, an explosive charge in the chamber, a fastener that is to be driven when the charge explodes, a piston separating the charge from the fastener, and a handle or grip with a trigger for actuating explosion of the charge.

Upon the pulling of a trigger switch, ignition of a charge creates gas in the combustion chamber, which pushes the piston so as to impact the positioned fastener and drive it into the workpiece. Fasteners are positioned in a nosepiece where they are held in a properly positioned orientation for receiving the impact of the piston. The piston is returned to its original or "ready" position by manually resetting the piston and chamber. The charges are typically secured or integrated onto a strip, similar to a belt of bullets for a machine gun, but stiffer. The strip with charges is advanced by a lever mechanism that engages the strip on one end and the piston (or a piston guide or similar structure) on the other end.

The mechanism for advancing the strip of charges typically includes a lever that not only pivots about a point, but often wobbles about the pivot. This wobble, or misalignment, can cause the mechanism advancing the strip to fail to advance the strip and, sometimes, actually causes the strip to move in the wrong direction, thus disposing a used charge where a fresh charge should be disposed.

SUMMARY AND OBJECTS OF THE INVENTION

In view of the foregoing, the principle object of this invention is to provide an improved device and method for advancing the strip of charges in a combustion-powered tool. More particularly, an object of this invention is to provide such an improve device and method that does not misalign and fail to advance the strip. Another object of the invention is to provide a combustion-activated tool having this improved device.

This invention provides a combustion-activated tool comprising (i) a housing having a longitudinal bore that extends to and connects with a vertical bore, (ii) a piston and piston guide disposed within the longitudinal bore and moveable axially therein, and (iii) an advance lever having a reset end and an advancing end, said lever disposed on a pivot skew to the axis of the longitudinal bore, the lever having an axis essentially parallel with the longitudinal bore, the advancing end of the lever attached on an arm of the lever angled to one side of the axis of the longitudinal bore and effective to engage teeth on the side of a strip of charges disposed in the vertical bore, the reset end of the lever being disposed on the same side of the axis of the longitudinal bore and engaging the piston guide.

In summary, the lever for advancing the strip of charges has one end that engages the piston guide and another that engages teeth or recesses on the strip of charges. The longitudinal and vertical bores are orthogonal to each other. Each of the charges on the strip is thus positioned, sequentially, at the intersection of the two bores. The advancing end of the lever is disposed to one side of the strip to engage the teeth thereon, and the reset end of the lever being disposed on the same side but at the position of the piston guide.

DETAILED DESCRIPTION OF SPECIFIC EMBODIMENTS

Figure 1A:
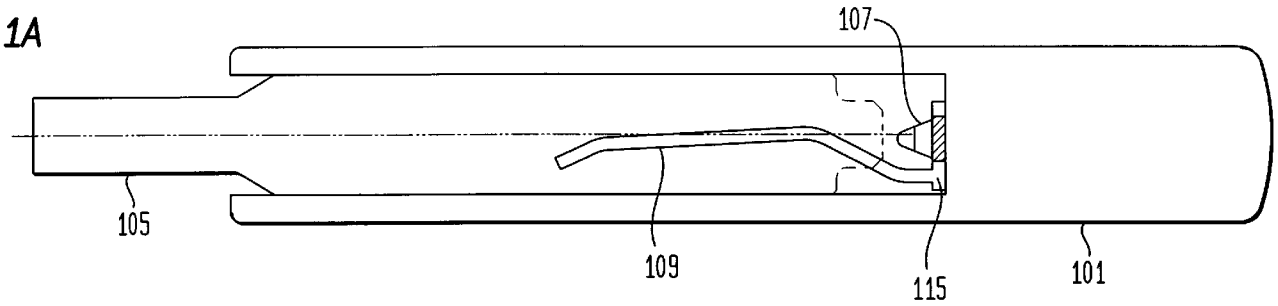
FIGS. 1A and 1B are idealized cutaway top and side views, respectively, of a combustion-actuated tool according to this invention.
Figure 1B:
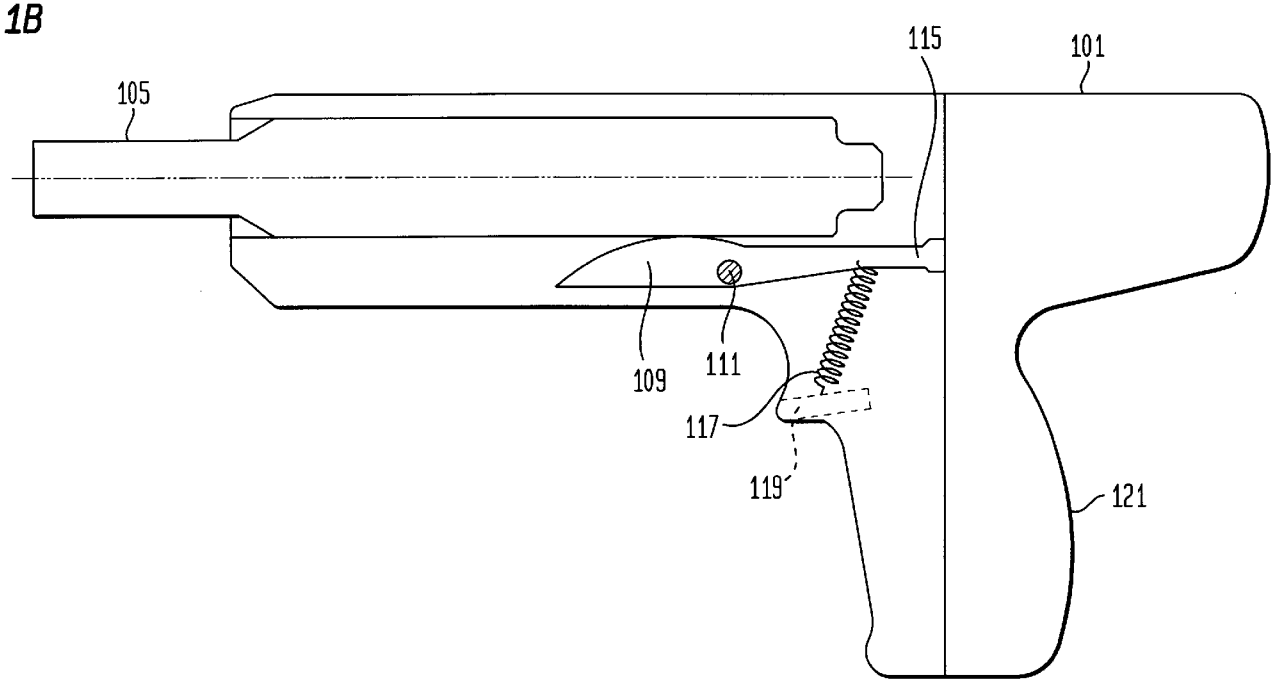
Figure 3:
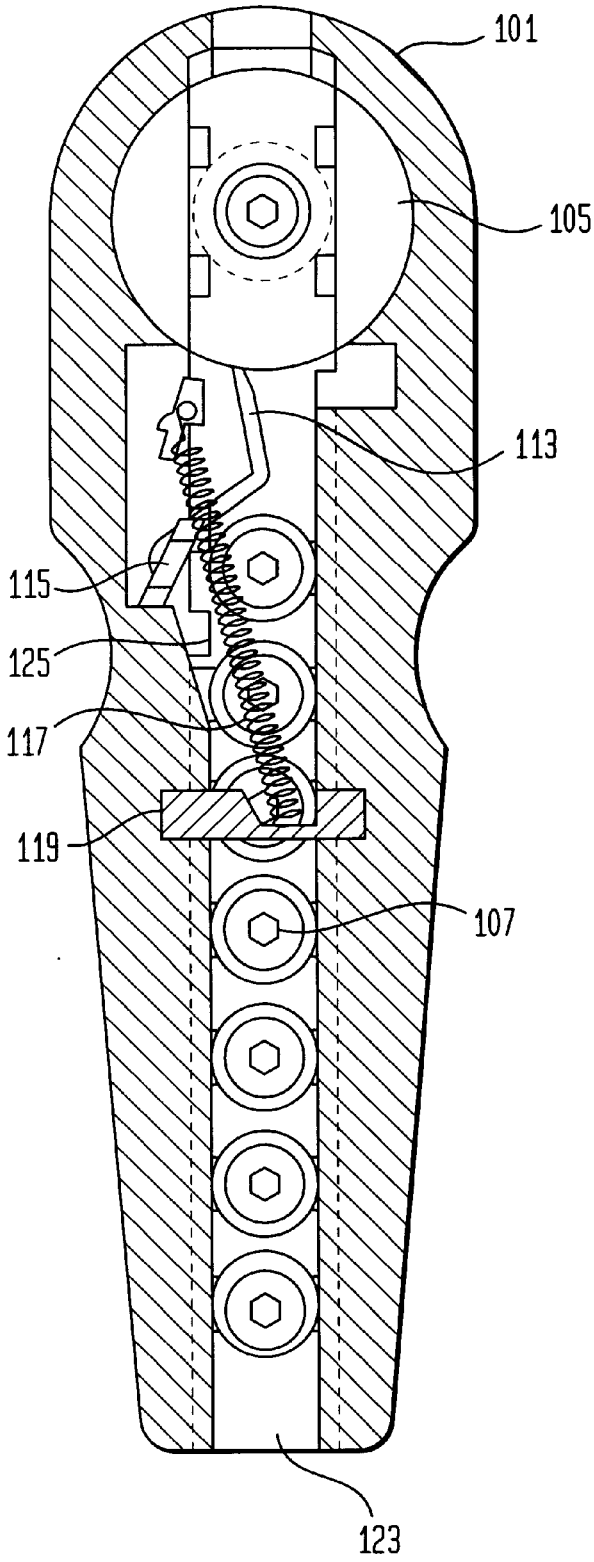
FIG. 3 is an idealized cutaway rear view of a combustion-actuated tool having a strip of charges to be advanced.

The combustion-actuated tool shown in FIGS. 1A and 1B includes a housing 101 with a longitudinal bore 103 in which is posed a piston guide 105 (in which is disposed a piston, not shown). The piston guide moves in the longitudinal bore. In the position where the device is ready to be fired, the piston guide is disposed towards the rear of the tool (as shown in FIG. 1A) so that the rear portion of the guide is adjacent a charge 107. The charge is disposed on a strip (as shown in FIG. 3) that is advanced by a lever 109 disposed on a pivot 111 and having a reset end 113 and an advancing end 115 that is activated, in part, by a trigger 119, connected to the lever by a spring 117, in the handle 121 of the tool. Such tools and methods for resetting the same are well known and are described, for example, in my co-pending application Ser. No. 322,543, filed May 28, 1999, the disclosure of which is incorporated herein by reference.

As noted in the Background section, the charge is ignited to expel combustion gases effective to ram the piston and piston guide into a fastener disposed at the other end of the longitudinal bore, thereby driving the fastener into a workpiece. Thus, the piston and piston guide move in the longitudinal bore away from the charge, and when the tool is reset, they move in the opposite direction. As the piston guide moves away from the charge, the reset end of the lever moves into the bore previously occupied by the guide. When the tool is reset, the piston guide engages the reset end of the lever, forcing that end towards the handle and thus pivoting the advancing end towards the longitudinal bore. As shown in FIG. 3, a strip of charges is disposed in a vertical bore 123 through the handle of the tool. When the piston guide is reset, it is moved towards the handle and engages the reset end of the lever, causing it to pivot so that the advancing end of the lever engages a tooth 125 (or recess between teeth) on the strip of charges and moves the strip to position the next charge adjacent the end of the piston guide in the configuration shown in FIG. 1A. As shown in FIG. 3; both the advancing end and the reset end of the lever are disposed on the same side of the centerline ℄ , the left side as shown in FIG. 3. By keeping the reset end of the lever on the same side as the advancing end, the advancing end is always forced back to the strip of charges. As described below, if the reset end were to reside on the other side of the centerline, the play in the pivot of the lever would force the advancing end of the lever away from the strip of charges.

Figure 2F:
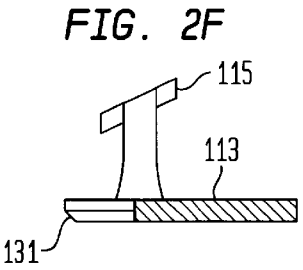
FIGS. 2A through 2F are, respectively, top, side, bottom, rear, and two cross-sectional (through lines E—E in FIG. 2C and F—F in FIG. 2A) views of levers according to this invention.
Figure 2D:
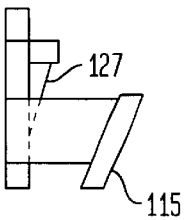
Figure 2E:
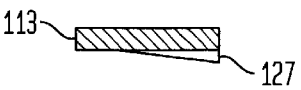
Figure 2A:
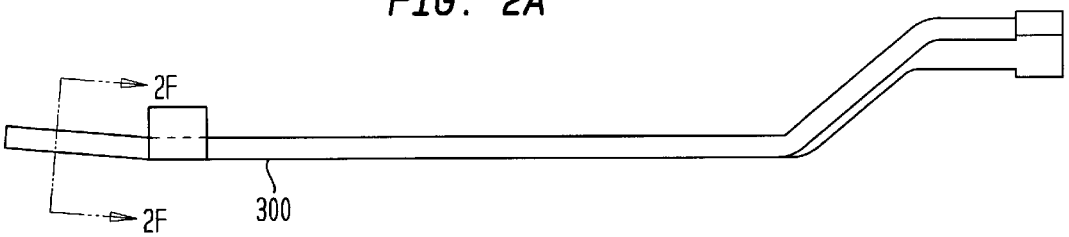
Figure 2B:
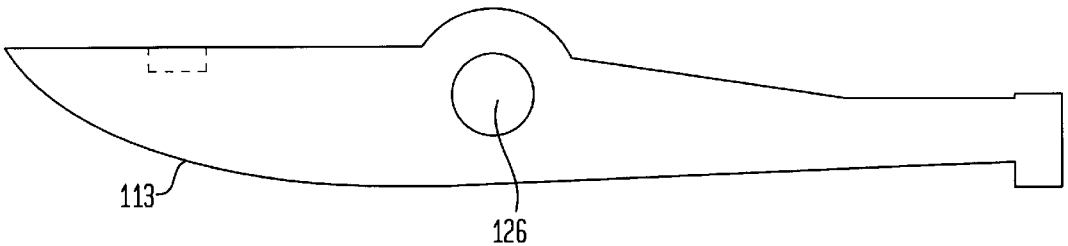
Figure 2C:
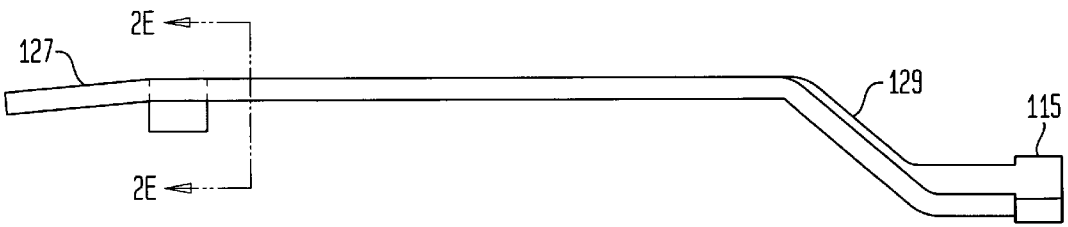

FIGS. 2A through 2E show various views embodiments of a lever useful for the present invention. The lever is mounted on the pivot through a hole 126 in the body of the lever. The reset end 113 has an angled portion 127. The advancing end 115 of the lever is disposed on an arm 129 that is also angled from the body of the lever. The angled portion and the arm are disposed on the same side of the body of the lever. In a most preferred embodiment, shown in FIG. 2F taken along line F—F in FIG. 2A, the edge of the lever has a bevel or knife edge 131 opposite the side to which the angled portion 127 is angled.

Figure 4A:
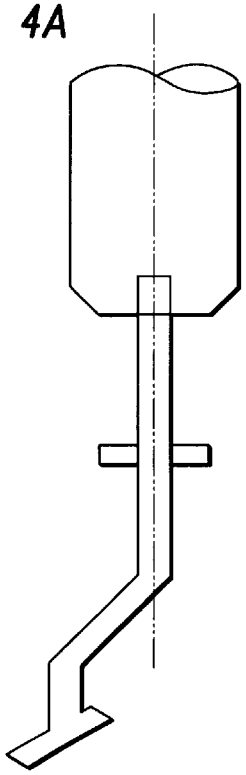
FIGS. 4A through 4D are idealized views showing the interaction between the lever and the piston guide.
Figure 4B:
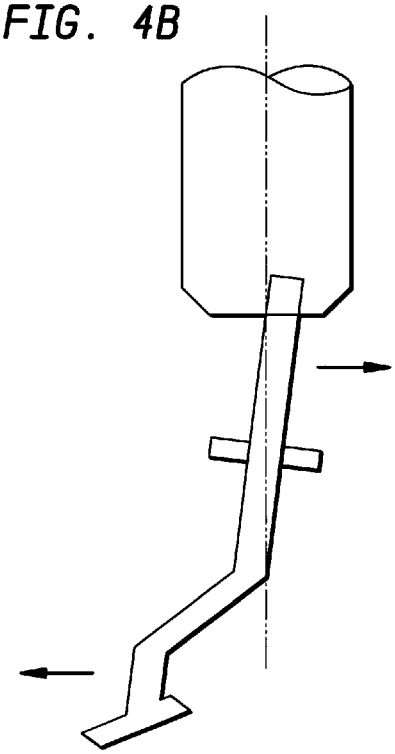
Figure 4C:
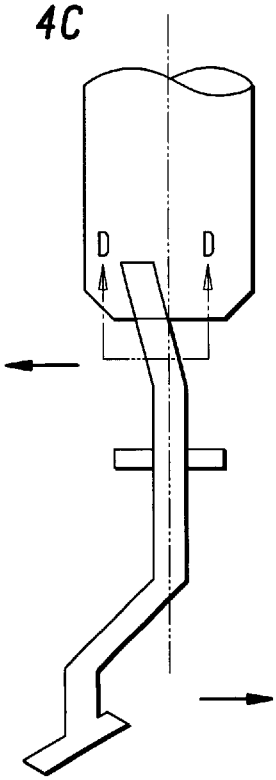
Figure 4D:
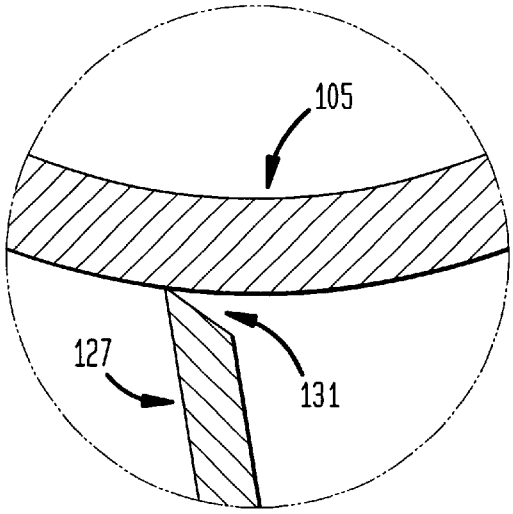

The import of the present invention is seen in FIGS. 4A through 4C. FIG. 4A shows an idealized top (or bottom) view of the lever disposed on the pivot where the reset end of the lever engages the piston guide. In the prior art construction shown in FIGS. 4A and 4B, it can be seen that the reset end of the lever can align on the center line of the longitudinal bore, essentially along the axis of the piston guide. In this position, because the piston guide is ground (annular), the reset end of the lever will engage the piston guide on one side of the center line or the other, perhaps randomly, as the lever pivots because no force maintains the lever in a desired position. As shown in FIG. 4B, if the reset end of the lever rides on the side of the center line opposite from that on which the advancing end is disposed (as shown by the upper arrow), the advancing end will be forced in the other direction (the direction of the lower arrow), so that the advancing end will be forced away from the strip of charges and will not engage the teeth on the strip and so will not advance the strip. FIG. 4C shows the lever of the present invention. The angled portion of the reset end is designed to stay on one side of the center line, so that when the lever engages the piston guide the reset portion is forced in the direction of the adjacent arrow. This forces causes the advancing end to be forced towards the strip of charges (in the direction of the arrow adjacent that end). By providing a lever having the advancing end and the reset end disposed on the same side of the body of the lever, the advancing end will not misalign but will always be forced into the strip of charges. FIG. 4D is a close-up cross-sectional view along line D—D in FIG. 4C showing the interaction of the bevelled edge 131 with the perimeter of the piston guide 105. In this figure, the advantage of the bevelled edge can be seen to facilitate maintaining the reset end on the proper side (here the left side) of the center line.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A combustion-activated tool, comprising:

a housing having a longitudinal bore that extends to and connects with a vertical bore;

a piston and piston guide disposed within the longitudinal bore and moveable axially therein;

an advance lever having a reset end and an advancing end, said lever disposed on a pivot orthogonal skew to the axis of the longitudinal bore, the lever having an axis essentially parallel with the longitudinal bore, the advancing end of the lever attached on an arm of the lever angled to one side of the axis of the longitudinal bore and effective to engage teeth on the side of a strip of charges disposed in the vertical bore, the reset end of the lever being disposed on the same side of the axis of the longitudinal bore and engaging the piston guide along an edge of the lever.

2. The tool of claim 1, further comprising a trigger disposed in the housing, the trigger being connected to the lever by a spring.

3. The tool of claim 1, wherein the edge of the lever engaging the piston guide has a bevel.

* * * * *